US006632005B1

(12) United States Patent
Johnson

(10) Patent No.: US 6,632,005 B1
(45) Date of Patent: Oct. 14, 2003

(54) ALABASTER FRAMING DEVICE

(75) Inventor: Aaron Johnson, Fort worth, TX (US)

(73) Assignee: Quorum International, LP, Fort Worth, TX (US)

( * ) Notice: Subject to any disclaimer, the term of this patent is extended or adjusted under 35 U.S.C. 154(b) by 0 days.

(21) Appl. No.: 09/598,754

(22) Filed: Jun. 22, 2000

(51) Int. Cl.[7] ..... F21S 8/06

(52) U.S. Cl. ..... 362/351; 362/405; 362/406; 362/806

(58) Field of Search ..... 362/405, 406, 362/806, 363, 367, 408, 453, 454, 455, 249, 123, 252; 428/13; 248/344

(56) References Cited

U.S. PATENT DOCUMENTS 5,779,346 A * 7/1998 Burke ..... 362/84
6,022,599 A * 2/2000 Rietveld et al. ..... 428/14
6,214,370 B1 * 6/2001 Bayer et al. ..... 362/405
6,398,388 B1 * 6/2002 Lorenzana et al. ..... 362/240
6,425,646 B1 * 7/2002 Andrews ..... 312/114

* cited by examiner

*Primary Examiner*—Sandra O'Shea
*Assistant Examiner*—Anabel Ton
(74) *Attorney, Agent, or Firm*—Kenneth C. Hill

(57) ABSTRACT

A lighting fixture component is in spaced relationship with a decorative material so as to leave the front and back side of the decorative material unobstructed. The decorative material is fixedly attached to, and enclosed by, the frame with a plurality of fasteners for attaching the decorative material to the frame by one edge wherein the edge is of sufficient thickness and hardness to support the decorative material.

20 Claims, 4 Drawing Sheets

ALABASTER FRAMING DEVICE

BACKGROUND OF THE INVENTION

1. Technical Field

The present invention generally relates to a lighting fixture and in particular to a structural element of a lighting fixture. Still more particularly, the present invention relates to a frame for a chandelier.

2. Description of the Related Art

The design possibilities in the electrical lighting industry are almost limitless. One of the few limitations is related to the design of the support apparatus, or in the case of a chandelier, the frame. In a chandelier, the frame must be strong enough to support and hold the desired shape of the chandelier. Decorative work involving the frame is limited so as not to render the frame non-functional.

An example of this decorative limitation is alabaster stone. Alabaster has an aesthetically pleasing translucent property and is often used as a light shade. However, alabaster is not utilized to ornamentally decorate the frame of a chandelier, generally due to the inability to provide sufficient support for the chandelier while still presenting the material in an aesthetically pleasing manner.

Also, in many homes, restaurants and commercial establishments, decorative chandeliers occupy permanent positions and contribute greatly to the beauty and style of the rooms in which they hang. Such chandeliers are often very expensive, constituting a significant investment for the owner. The high cost of removing or replacing chandeliers often creates a significant problem when one wishes to redecorate a room having an existing chandelier in place. The result is that, in many cases, those who wish to redecorate either refrain from doing so or are forced to live with chandeliers that do not conform to their desired decorative schemes.

Efforts at resolving this problem have been made in the past. For example, some solutions disclose a lighting fixture in which the arms supporting light bulbs and glassware may be removed from the chandelier or placed into the chandelier in different configurations. However these are extremely inconvenient to use in that they often require interfering with the electrical leads to the light bulbs. In all cases, a person must manipulate the lighting element of the chandelier in some respect or must tediously replace perhaps hundreds of decorative ornaments.

Accordingly, a need exists for a versatile chandelier in which the decorative material can be replaced without the use of specialized tools and by an unskilled person with a minimum of time and effort. In addition, it would be desirable to have a device that would both display a selected decorative material and provide support for a chandelier. It would be desirable if the overall look of a chandelier could be easily changed without manipulating the lighting elements. A need also exists for a technique of providing high quality individually customized chandeliers at reduced cost.

SUMMARY OF THE INVENTION

It is therefore one object of the present invention to provide a lighting fixture component which can display a decorative material while at the same time provide support for a chandelier.

It is another object of the present invention to provide a lighting fixture component that would allow for ease of replacement and repair of the decorative material.

It is still another object of the present invention to provide a lighting fixture, as aforesaid, which has an aesthetically pleasing appearance.

The foregoing objects are achieved as is now described. A lighting fixture component is in spaced relationship with a decorative material so as to leave the front and back side of the decorative material unobstructed. The decorative material is fixedly attached to, and enclosed by, the frame with a plurality of fasteners for attaching the decorative material to the frame by one edge wherein the edge is of sufficient thickness and hardness to support the decorative material.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1A:
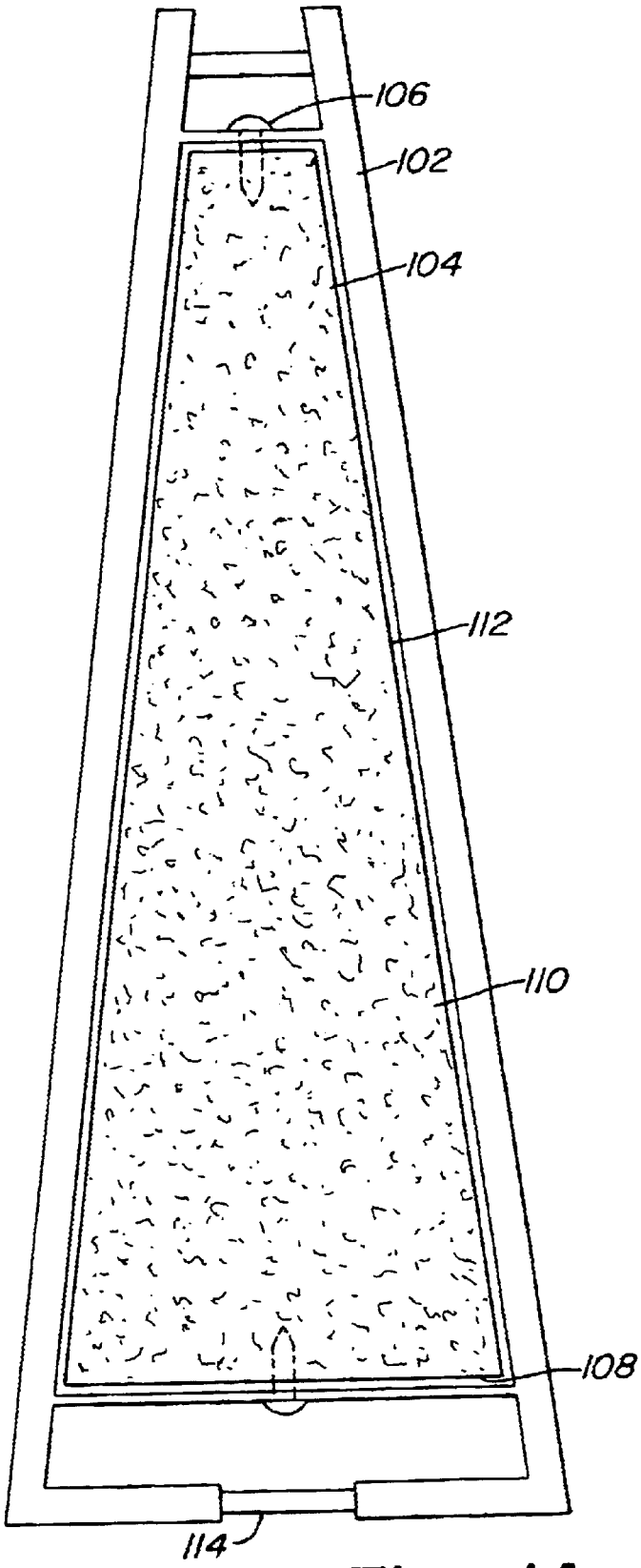
FIG. 1A is a line drawing of a lighting fixture component for a lighting fixture in accordance with a preferred embodiment of the present invention.
Figure 1B:
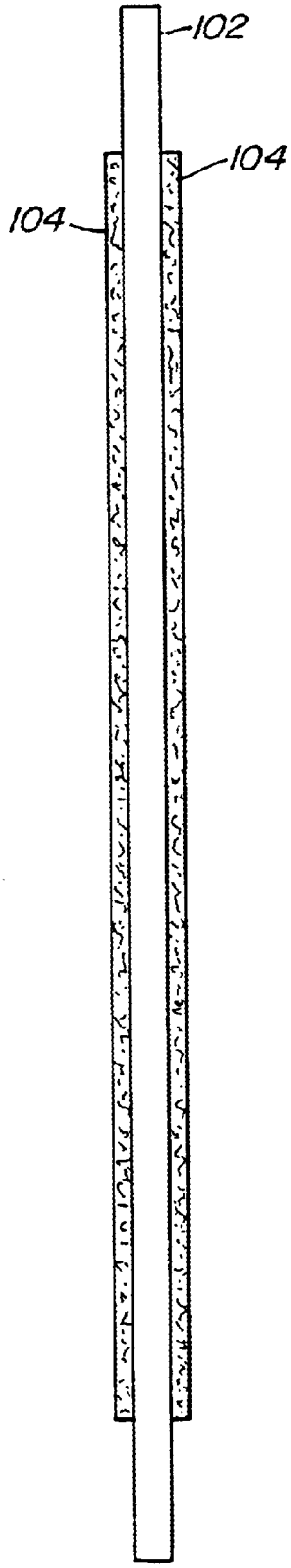
FIG. 1B is a line drawing of a side view of a lighting fixture component for a lighting fixture in accordance with a preferred embodiment of the present invention.
Figure 1C:
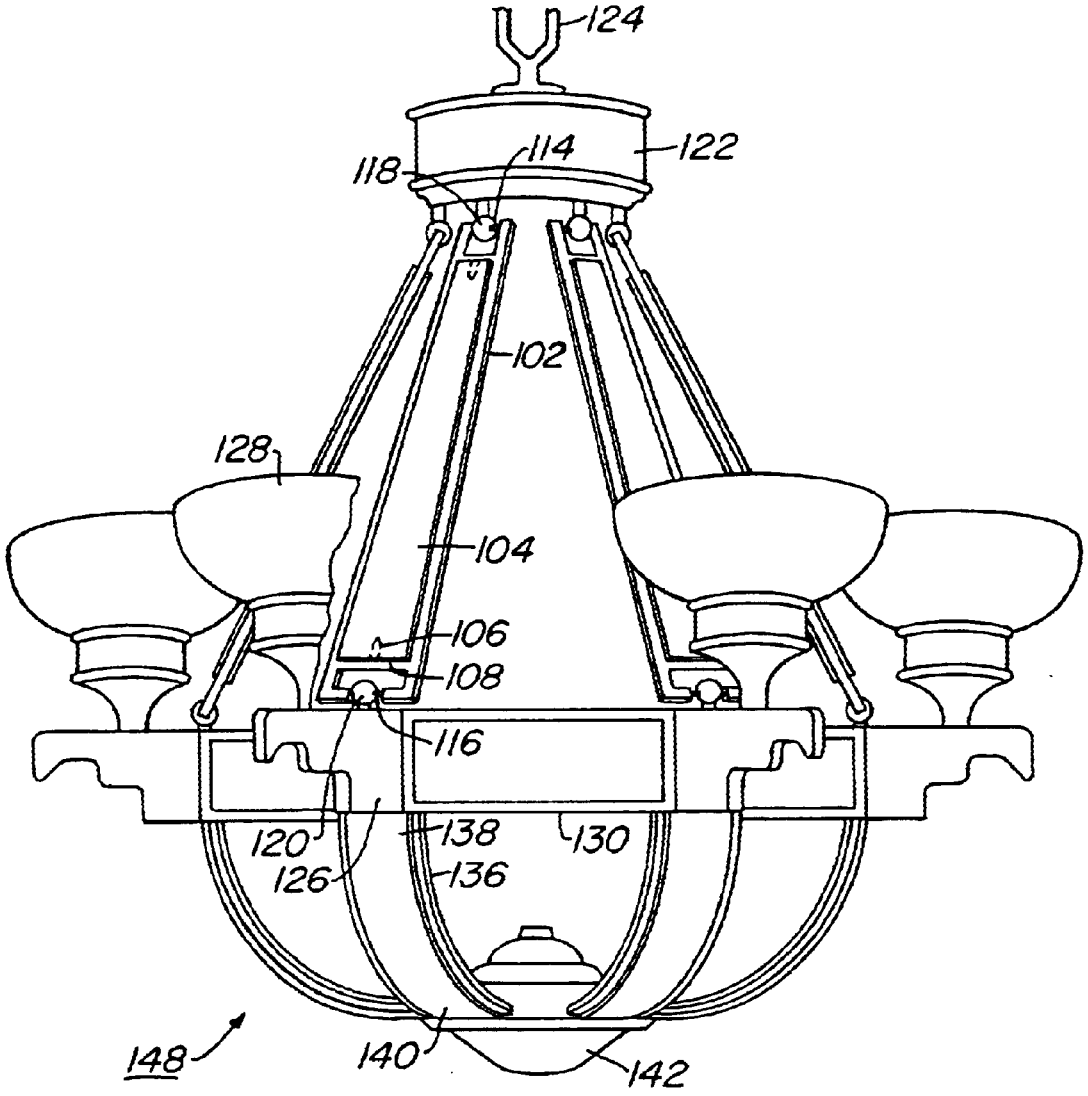
FIG. 1C is a line drawing of a chandelier in accordance with a preferred embodiment of the present invention.

With reference now to the figures, and in particular with reference to FIGS. 1A through 1C, a support member for a lighting fixture in accordance with a preferred embodiment of the present invention is depicted. FIG. 1A depicts a frame 102, a decorative material 104, and fasteners 106, (including screws, bolts, dowels, etc.). Fasteners 106 are fixedly attached to frame 102 and extend into edge 108 of decorative material 104 so as to leave front side 110 and back side 112 of decorative material 104 unobstructed or exposed. Edge 108 of decorative material 104 is of sufficient thickness and hardness to support the entire weight of decorative material 104.

It is well known that stones vary in hardness from one type to another. Such hardness is often expressed through a material hardness scale (expressed in Mohs) in which a diamond, the hardest stone, is ranked 10 and talc, the softest stone, is ranked 1. Those stones which are not crystals and which have a Mohs hardness of greater than 1 can be cut into slabs which are thin enough to be translucent (transmit light). Also, the slabs are strong enough to maintain their integrity and may be used as a decorative material.

Fasteners 106 are positioned such that they can be removed from edge 108 of decorative material 104 when decorative material 104 needs to be replaced. Decorative material 104 may be replaced when broken, when the user wants to change the type of decorative material 104 or for any other reason the user may want to replace decorative material 104. In the preferred embodiment, decorative material 104 is alabaster. However, any such similar material can be used such as glass, plastic, or any other translucent stone.

Frame 102 is constructed of a material and in such a shape that it adds support to a chandelier and is aesthetically pleasing. Frame 102 comprises a first connective bar 114 and a second connective bar 116 at opposite ends of frame 102. The chandelier is made of connected frames of similar construction as that shown in FIG. 1A except for the different shapes and sizes necessitated by design and aesthetic reasons.

FIG. 1B depicts a side view of a lighting fixture component in accordance with the present invention. As may be seen, the thickness of the decorative material 104 may be greater than the thickness of frame 102, with opposing surfaces of decorative material 104 being exposed. Ordinarily, stone materials are inlaid (with a backing surface covering one face of the material) rather than framed as in the present invention.

Given the relative thicknesses of the decorative material 104 and the frame 102, a tongue-and-groove configuration may be utilized to retain decorative material 104 within frame 102 rather than fasteners 106. In such an implementation, frame 102 is preferably constructed to permit disassembly, allowing the decorative material 104 to be replaced.

FIG. 1C is a diagram of a chandelier in accordance with a preferred embodiment of the present invention. Chandelier 148 includes various frames and connecting bars and brackets. First connective bar 114 and second connective bar 116 on frame 102 are attached to first connecting bracket 118 and second connecting bracket 120 respectively. First connecting bracket 118 is attached to distributor 122. Distributor 122 is attached to ceiling mount 124. Second connecting bracket 120 is attached to light block 126. Light block 126 supports light element 128.

Frame 130 is attached to light block 126. Frame 136 comprises a first end 138 and a second end 140. First end 138 of frame 136 is attached to light block 126. Second end 140 of frame 136 is attached to decorative element 142. Electrical wiring extends through frame 102 and is attached to light element 128.

In a lighting fixture, such as a chandelier described above, the frames display decorative material, in this instance alabaster, while at the same time provide support for the chandelier. Also, because the alabaster is supported by fasteners, the alabaster can be easily replaced or repaired by an unskilled person with a minimum of time and effort. By replacing the alabaster in all or part of the chandelier, an entire new look to the chandelier can be achieved.

Figure 2:
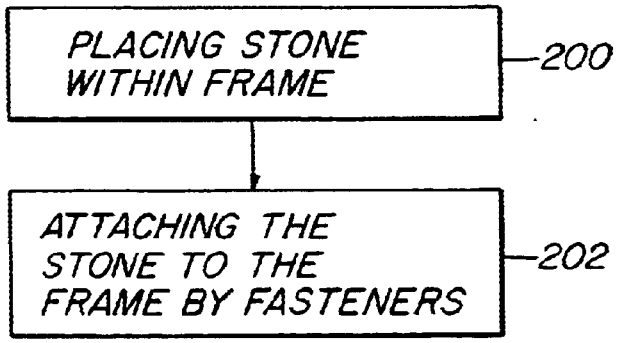
FIG. 2 is a high-level block diagram exemplifying a method for mounting stone for a lighting fixture in accordance with a preferred embodiment of the present invention.
Figure 3:
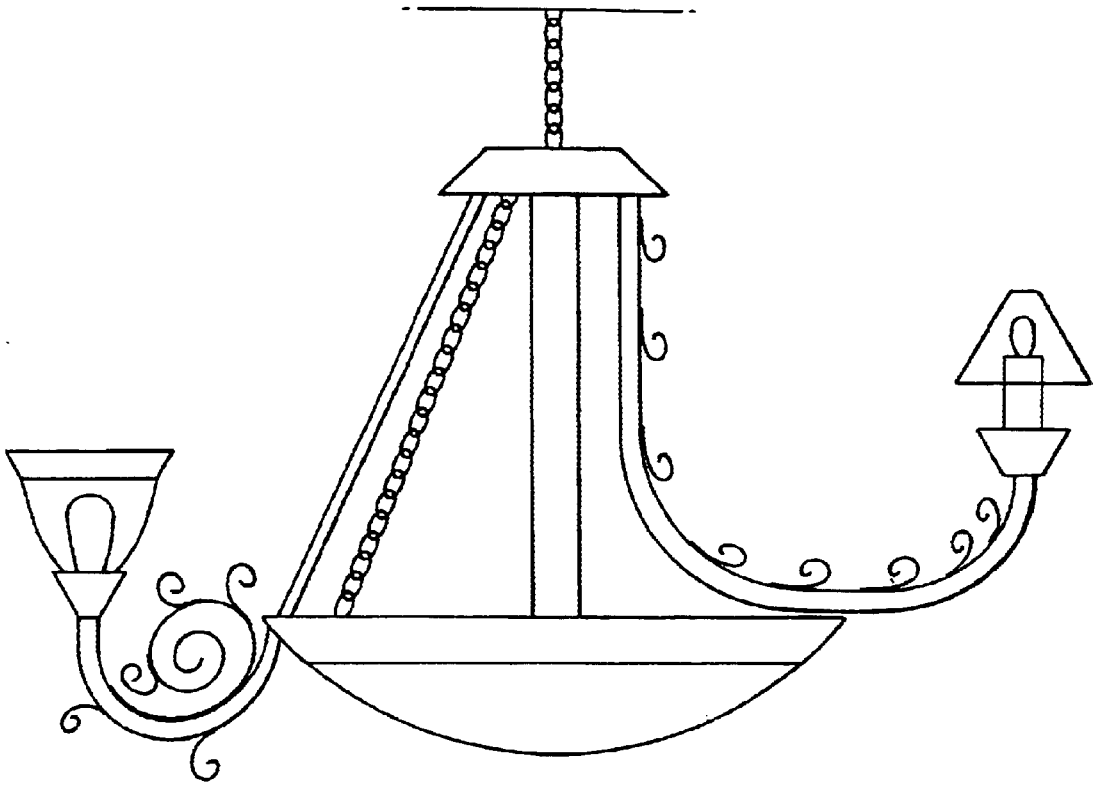
Fig. 3 (PRIOR ART)
FIG. 3 is a line drawing of common prior art.
Figure 3:
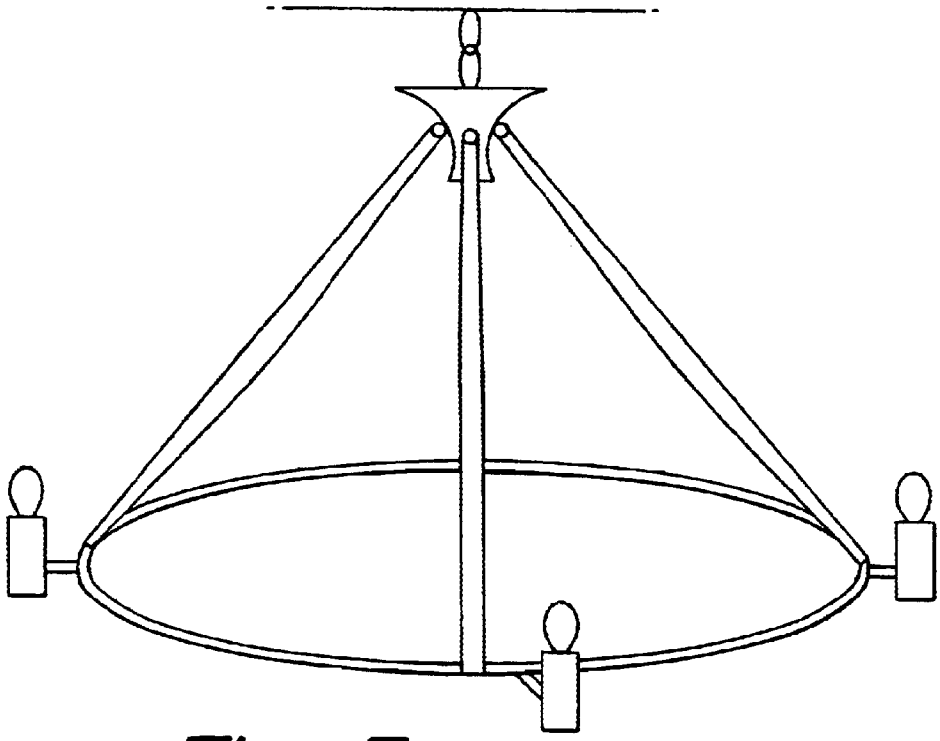
Fig. 3 (PRIOR ART)

Referring to FIG. 2, a high-level block diagram exemplifying a method for mounting stone for a lighting fixture in accordance with a preferred embodiment of the present invention is illustrated. In order to further clarify this method, reference to FIGS. 1A and 1B is encouraged and will be referred to throughout the following process steps. The process begins with step 200, which depicts placing a decorative material 104, such as stone, having at least one edge 108 supported in spaced relationship, wholly enclosed within frame 102. Decorative material 104 is positioned so as to leave front side 110 and back side 112 of decorative material 104 unobstructed. The process next passes to step 302, attaching the decorative material 104 to the frame 102. Fasteners 106 are fixedly attached to frame 102 and extend into edge 108 of decorative material 104 so as to leave front side 110 and back side 112 of decorative material 104 unobstructed. At least one edge of decorative material 104 is of sufficient thickness and hardness to receive the fasteners and support the stone, thereby mounting decorative material 104 on a lighting fixture. Those skilled in the art will recognize there are other ways to attach decorative material 104 to frame 102. Also, different types of decorative material 104 other than stone can be utilized. For example, decorative material 104 can be translucent or opaque. In the preferred embodiment, decorative material 104 is alabaster.

While the invention has been particularly shown and described with reference to a preferred embodiment, it will be understood by those skilled in the art that various changes in form and detail may be made therein without departing from the spirit and scope of the invention.

What is claimed is:

1. A light fixture, comprising:

a plurality of light elements for radiating light;

a light block connected to each light element, to provide support therefore;

a plurality of frame elements connected to the light blocks, the frame elements holding the light blocks in a spaced apart relationship, each frame element having at least two edges defining a frame space between them, the frame space defining a surface with the frame element edges along boundaries of the frame space;

a distributor connected to a first subset of the frame elements;

wiring connected to the distributor and to each light element for conducting electrical current; and decorative material inserts removably attached to each frame element so as to substantially fill each frame space, each decorative material insert defining a surface corresponding to the surface defined by the frame space and having edges, wherein each decorative material insert edge is adjacent to, and coplanar with, a corresponding frame element edge.

2. The light fixture of claim 1, further comprising:

a decorative element attached to a second subset of frame elements.

3. The light fixture of claim 2, wherein the decorative element is connected to at least three frame elements, as is suspended below the light blocks underneath the distributor.

4. The light fixture of claim 1, further comprising a ceiling mount attached to the distributor and adapted to suspend the light fixture from a ceiling.

5. The light fixture of claim 1, containing at least three light elements, and wherein the frame elements are connected to the light blocks and the distributor so as to define a chandelier.

6. The light fixture of claim 5, further comprising:

a decorative element attached to a second subset of frame elements.

7. The light fixture of claim 6, wherein the decorative element is connected to at least three frame elements, as is suspended below the light blocks underneath the distributor.

8. The light fixture of claim 7, further comprising a ceiling mount attached to the distributor and adapted to suspend the light fixture from a ceiling.

9. The light fixture of claim 1, wherein the decorative material inserts comprise an opaque material.

10. The light fixture of claim 1, wherein the decorative material inserts comprise a translucent material.

11. The light fixture of claim 1, wherein the decorative material inserts comprise translucent stone.

12. The light fixture of claim 11, wherein the decorative material inserts comprise alabaster.

13. The light fixture of claim 1, wherein the decorative material inserts are attached along their edges to the corresponding frame element edges by fasteners that extend from the frame element edges through the corresponding decorative material insert edges and into the interior of the decorative material inserts.

14. The light fixture of claim 13, wherein the fasteners comprise bolts.

15. The light fixture of claim 13, wherein the fasteners comprise screws.

16. The light fixture of claim 13, wherein the fasteners comprise dowels.

17. A light fixture, comprising:

a plurality of light elements for radiating light;

a light block connected to each light element, to provide support therefore;

a plurality of frame elements connected to the light blocks, the frame elements holding the light blocks in a spaced apart relationship, each frame element having at least two edges defining a frame space between them, the frame space defining a surface with the frame element edges along boundaries of the frame space;

a distributor connected to a first subset of the frame elements;

wiring connected to the distributor and to each light element for conducting electrical current; and decorative material inserts removably attached to each frame element so as to substantially fill each frame space, each decorative material insert defining a surface corresponding to the surface defined by the frame space and having edges, wherein each decorative material insert edge is adjacent to, and coplanar with, a corresponding frame element edge, wherein each decorative material insert has a thickness normal to a surface containing the decorative material insert and the frame element edges corresponding to the decorative material insert edges, and wherein the decorative material insert thicknesses are greater than thicknesses of the corresponding frame element edges in such normal direction.

18. The light fixture of claim 1, wherein each frame element of the first subset of frame elements is elongated in shape, having two opposing frame element edges substantially longer than all remaining frame element edges.

19. A light fixture, comprising:

a plurality of light elements for radiating light;

a light block connected to each light element, to provide support therefore;

a plurality of frame elements connected to the light blocks, the frame elements holding the light blocks in a spaced apart relationship, each frame element having at least two edges defining a frame space between them, the frame space defining a surface with the frame element edges along boundaries of the frame space;

a distributor connected to a first subset of the frame elements;

wiring connected to the distributor and to each light element for conducting electrical current; and decorative material inserts removably attached to each frame element so as to substantially fill each frame space, each decorative material insert defining a surface corresponding to the surface defined by the frame space and having edges, wherein each decorative material insert edge is adjacent to, and coplanar with, a corresponding frame element edge, wherein the opposing frame element edges for each frame element of the first subset are not parallel.

20. A light fixture, comprising:

a plurality of light elements for radiating light;

a light block connected to each light element, to provide support therefore;

a plurality of frame elements connected to the light blocks, the frame elements holding the light blocks in a spaced apart relationship, each frame element having at least two edges defining a frame space between them, the frame space defining a surface with the frame element edges along boundaries of the frame space;

a distributor connected to a first subset of the frame elements;

wiring connected to the distributor and to each light element for conducting electrical current; and decorative material inserts removably attached to each frame element so as to substantially fill each frame space, each decorative material insert defining a surface corresponding to the surface defined by the frame space and having edges, wherein each decorative material insert edge is adjacent to, and coplanar with, a corresponding frame element edge, wherein the decorative material insert surfaces are curved.

* * * * *